US007258046B2

(12) United States Patent
Frühm et al.

(10) Patent No.: US 7,258,046 B2
(45) Date of Patent: Aug. 21, 2007

(54) SCREWDRIVER BIT CARTRIDGE RETAINER

(75) Inventors: Hermann Frühm, Coquitlam (CA); Waltherus Christianus Klomp, Delta (CA)

(73) Assignee: Winsire Enterprises Corporation, New Westminster, British Columbia (CA)

( * ) Notice: Subject to any disclaimer, the term of this patent is extended or adjusted under 35 U.S.C. 154(b) by 0 days.

(21) Appl. No.: 11/216,010

(22) Filed: Sep. 1, 2005

(65) Prior Publication Data

US 2007/0044598 A1 Mar. 1, 2007

(51) Int. Cl.
*B25B 23/16* (2006.01)

(52) U.S. Cl. ..... 81/177.4; 81/438

(58) Field of Classification Search ..... 81/177.4, 81/490, 437–439

See application file for complete search history.

(56) References Cited

U.S. PATENT DOCUMENTS 2,378,775 A * 6/1945 Johnson ..... 81/438
4,428,570 A * 1/1984 Foshee et al. ..... 267/164
4,924,733 A * 5/1990 McKenzie ..... 81/438
5,265,504 A 11/1993 Frühm
6,030,092 A * 2/2000 McCalla et al. ..... 362/120
6,510,768 B2 1/2003 Frühm
7,051,629 B2 * 5/2006 Huang ..... 81/489
2002/0184979 A1 12/2002 Frühm

FOREIGN PATENT DOCUMENTS

WO WO 00/09295 2/2000

* cited by examiner

*Primary Examiner*—Hadi Shakeri
(74) *Attorney, Agent, or Firm*—Oyen Wiggs Green & Mutala LLP

(57) ABSTRACT

A retainer for constraining slidable movement of a sleeve along a shaft between open and closed positions. An end cap is fixed on the sleeve's rearward end, forming a recess between the sleeve's rearward end and the end cap. The retainer is slidable in and along the sleeve. A pair of flexible, transversely opposed ribs are provided at the retainer's rearward end. A lug projects outwardly from each rib's rearward end. A spring normally biases the ribs outwardly, biasing the lugs into the recess when the sleeve is closed to retain the sleeve in the closed position. When the sleeve is closed, application of a force to move the end cap rearwardly away from the shaft compresses the lugs inwardly, compressing the ribs against the spring and overcoming the spring's outward bias, such that the lugs circumscribe a reduced circumference permitting slidable movement of the lugs through the sleeve.

16 Claims, 8 Drawing Sheets

SCREWDRIVER BIT CARTRIDGE RETAINER

TECHNICAL FIELD

This disclosure pertains to releasable retention of screwdriver bit storage cartridges.

BACKGROUND

FIGS. 1, 2 and 3 depict a prior art battery-powered screwdriver 10 having a bit holding cartridge 12. Screwdriver 10 has a casing 14 within which a compartment 16 is formed for containing battery 17 (shown schematically only in FIGS. 2 and 3). Battery 17 powers motor 18 (shown schematically only in FIGS. 1 and 2) when rocker switch 20 is actuated, rotating shaft 22 about its longitudinal axis. Shaft 22 is drivingly coupled to motor 18 by a gearing mechanism (not shown) within forward compartment 24. A hexagonal cross-section tool bit holding chuck 26 is provided in the open forward end of shaft 22 for removably and lockably receiving any one of a number of different (preferably double-ended) screwdriver type tool bits 27 (FIGS. 1 and 3), or an assortment of drill type tool bits 27A (FIG. 2) removably stored on cartridge 12. The external surface of casing 14 defines a handle for grasping screwdriver 10.

The end of casing 14 opposite shaft 22 is extended rearwardly (i.e. to the right, as viewed in FIGS. 2 and 3) to define a bit holder storage compartment 28 rearwardly of battery storage compartment 16. A pair of opposed flanges 30, 32 are formed to extend circumferentially around the inner cylindrical surface of casing 14, rearwardly of battery storage compartment 16. Flanges 30, 32 are spaced apart to define a circumferential groove 34 for fixedly retaining the circular rim of base 36 of support shaft 38. As best seen in FIGS. 2 and 3, base 36 is flared radially inwardly and rearwardly to define an anchor flange portion 40 at the juncture of base 36 and shaft 38.

A cylindrically apertured sleeve 42 is formed on the central rearward face of support collar 44 and extends rearwardly therefrom. Stop shoulder 46 on support collar 44 circumferentially surrounds shaft 38 for slidable, longitudinal movement of sleeve 42 and collar 44 forwardly or rearwardly along shaft 38 between the closed and open positions respectively shown in FIGS. 2 and 3. The circumferential outward rim of collar 44 is flanged to bear against the inner cylindrical surface of compartment 28 thereby stabilizing cartridge 12 and preventing wobbling of sleeve 42 during slidable movement thereof along shaft 38.

An inwardly flexible retainer 47 is fixed on the rearward end 49 of shaft 38. This can be accomplished, as shown in FIG. 2, by providing external threading 48 on rearward end 49 of shaft 38 and screwing an internally threaded portion (not shown) of retainer 47 onto the threaded shaft end. Alternatively, as shown in FIG. 3, a spring-biased type clip 50 can be provided on the forward end of retainer 47 for snap-fit engagement within a mating flanged portion 51 formed within the rearward end of shaft 38.

Retainer 47 is formed with a plurality of flexible, radially spaced segments 52 separated by slots 54. When bit cartridge 12 is in the closed position shown in FIG. 2, segments 52 flex radially outwardly, forcing the outwardly protruding circumferential ridged portions 56 of segments 52 into snap-fit engagement within radially outwardly enlarged circumferential recess 58 provided between the rearward end of sleeve 42 and the central, forward face of end cap 60 to firmly retain cartridge 12 in the closed position. The forward end of retainer 47 protrudes radially outwardly around the rearward end of shaft 38, thereby serving as an end stop to limit rearward travel of sleeve 42 on shaft 38 when stop shoulder 46 contacts the forward end of retainer 47.

A cylindrically apertured collar 62 is formed around the central, forward face of cap 60. The circumferential inward surface of collar 62 is securely circumferentially bonded to the rearward end of sleeve 42. To move bit cartridge 12 into the open position shown in FIG. 3, the user grasps end cap 60 and draws it longitudinally away from screwdriver 10 (i.e. by pulling end cap 60 to the right, as viewed in FIG. 2). The force so exerted compresses segments 52 of retainer 47 radially inwardly within recess 58, such that ridges 56 circumscribe a reduced circumference capable of passage through the cylindrically apertured portion of sleeve 42, as sleeve 42 is slidably drawn along shaft 38 into the fully open position shown in FIG. 3.

A second collar 64 is formed around the central, forward face of cap 60 circumferentially surrounding collar 62. The forwardly protruding portion of collar 64 is received within the rearward circumferential end of casing 14 when bit cartridge 12 is in the closed position, as shown in FIG. 2.

A plurality of flexible bit holding clips 66 are spaced radially and fixed around the central outer circumference of sleeve 42. One bit can be press fitted and thus removably retained between each opposed pair of clips 66 to removably retain the bit. A plurality of different bits can be similarly removably retained by utilizing all of the available pairs of clips 66 on bit cartridge 12. When cartridge 12 is in the open position shown in FIG. 3, it can easily be rotated with respect to shaft 38, thereby allowing the user to easily inspect all of the bits removably stored on cartridge 12 and select a particular bit. The selected bit can be removed by pulling it outwardly away from the clips 66 which retain it. End cap 60 is then pressed toward screwdriver 10 to slidably replace cartridge 12 within bit storage compartment 28 in the closed position shown in FIG. 2.

Persons skilled in the art will understand that bit cartridge 12, retainer 47 and cap 60 are readily adapted to use with manually operated screwdrivers, for example as disclosed in U.S. Pat. No. 5,265,504.

Retainer 47 is typically formed of plastic or other suitable flexible material. It can be difficult to achieve uniform resilience in multiple batches of retainer 47 for high volume production of screwdriver 10. If different specimens of retainer 47 have different resilience then the operating characteristics of different screwdrivers incorporating those different retainers may be affected. For example, the snap-fit engagement of segments 52 within recess 58 may be relatively tight in one screwdriver, and relatively loose in another screwdriver. Extra effort may be required to move cartridge 12 between its open and closed positions in the case of relatively tight snap-fit engagement of segments 52 within recess 58, whereas cartridge 12 may be insufficiently retained in the closed position in the case of relatively loose snap-fit engagement of segments 52 within recess 58.

The resilience of retainer 47 may also vary over time. For example, when bit cartridge 12 is in the open position retainer 47's segments 52 are compressed within the cylindrically apertured portion of sleeve 42. If cartridge 12 is left open more than several hours, then the capability of segments 52 to flex radially outwardly into snap-fit engagement within recess 58 may be degraded, weakening such engagement and preventing retainer 47 from retaining cartridge 12 in its closed position, thus permitting undesirable slippage of cartridge 12 from the closed position toward the open position. Consequently, it is impractical to display screwdriver 10 for sale in transparent packaging with cartridge 12 in its open position. Such display is however desirable, because it lets prospective purchasers see cartridge 12 and any bits stored therein. The resilience of retainer 47 may also vary with temperature.

This disclosure addresses the shortcomings of retainer 47. The foregoing examples of the related art and limitations related thereto are intended to be illustrative and not exclusive. Other limitations of the related art will become apparent to those of skill in the art upon a reading of the specification and a study of the drawings.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 4A:
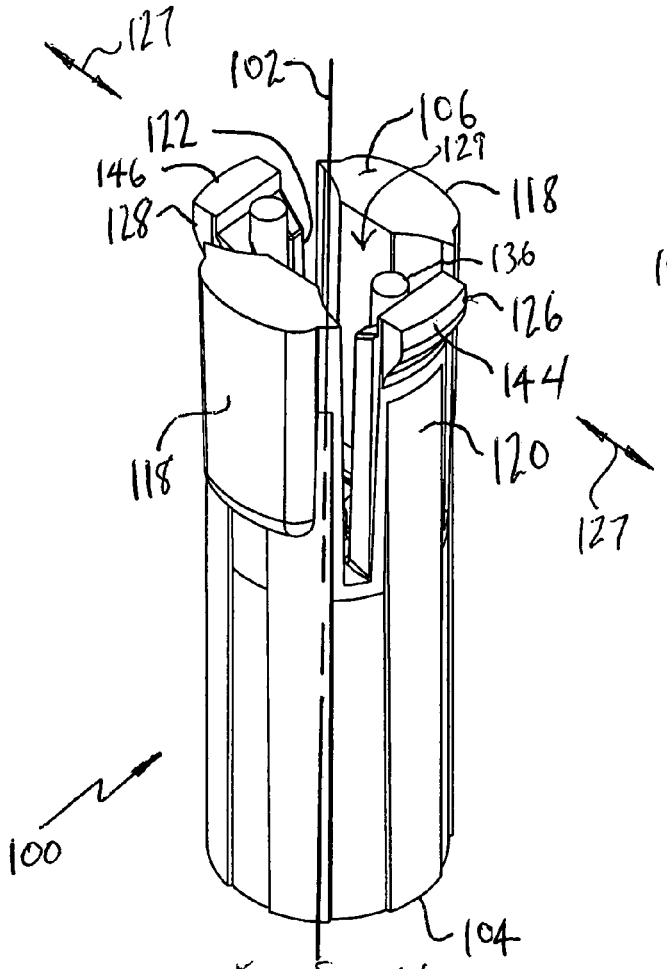
FIGS. 4A and 4B are respectively top and bottom oblique pictorial illustrations of a screwdriver bit cartridge retainer in accordance with this disclosure.
Figure 4B:
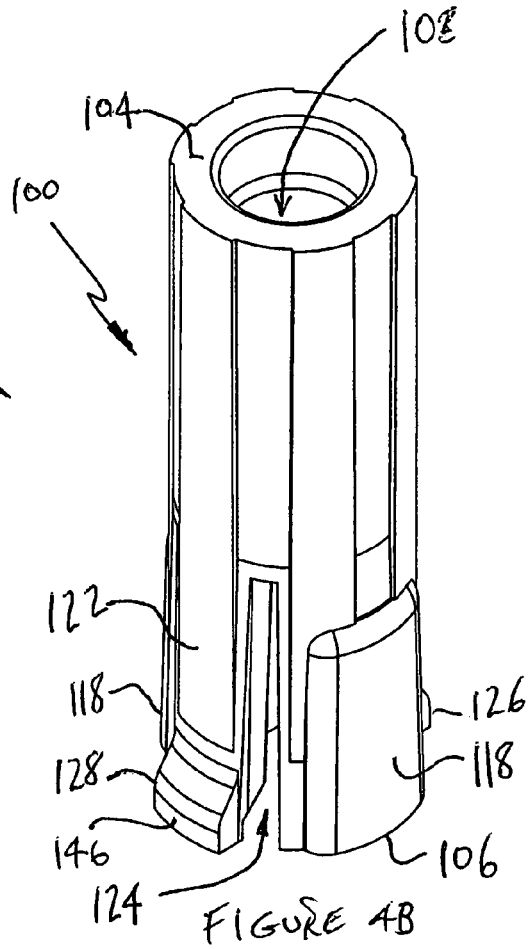
Figure 4C:
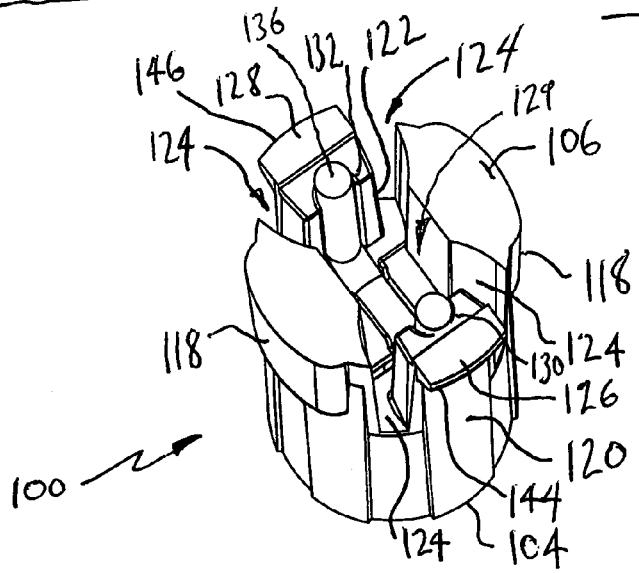
FIG. 4C is similar to FIG. 4A, but depicts the retainer from a steeper oblique angle than FIG. 4A.
Figure 5A:
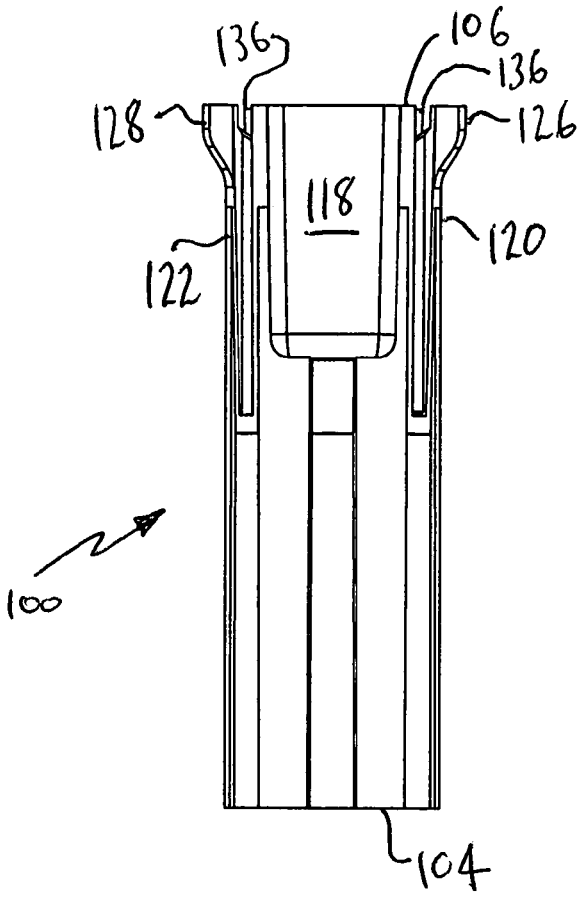
FIGS. 5A, 5B and 5C are respectively front elevation, left side elevation and bottom plan views of the retainer shown in FIGS. 4A-4C.
Figure 5B:
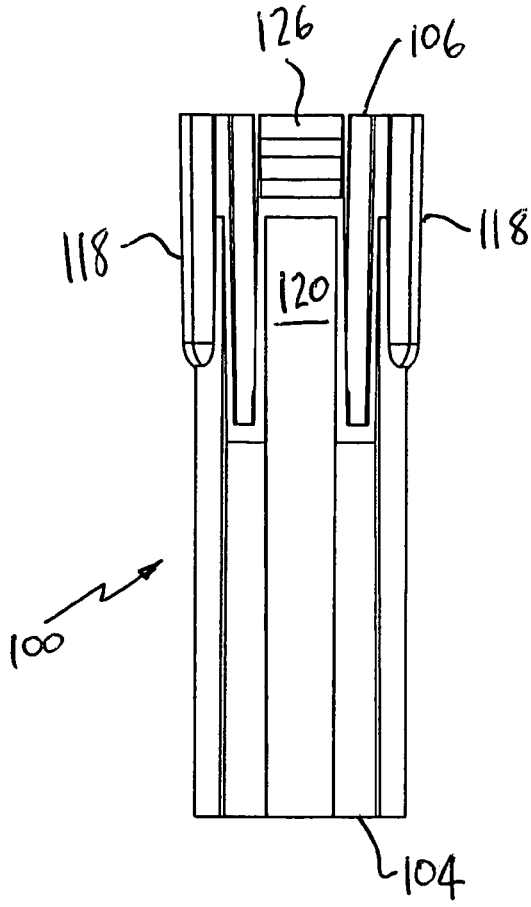
Figure 5C:
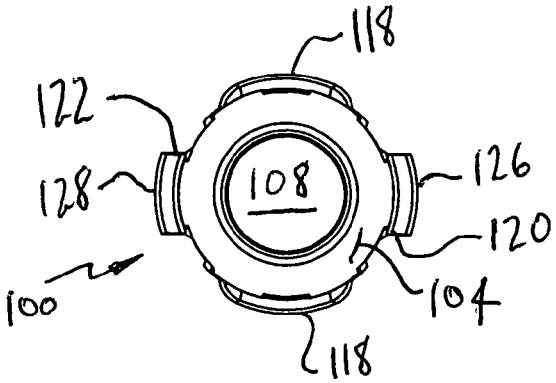
Figure 6:
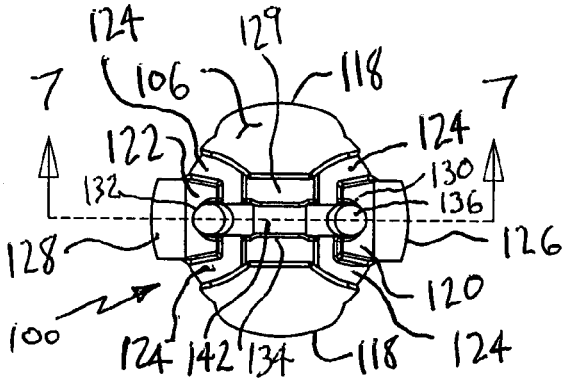
FIG. 6 is a top plan view of the retainer shown in FIGS. 4A-4C and 5A-5C.

FIGS. 4A-4C, 5A-5C, 6-9, 11A-11C and 12B depict a screwdriver bit cartridge retainer 100 for constraining slidable movement of prior art sleeve 42 along prior art support shaft 38 between the above-described open and closed positions. Retainer 100 may be formed of a flexible material such as plastic. The body of retainer 100 is generally cylindrical about its longitudinal axis 102 (FIG. 4A) and has a forward end 104 and a rearward end 106. As used herein, "inward" means the radial direction oriented toward axis 102 in a plane perpendicular to axis 102, and "outward" means the radial direction oriented away from axis 102 in a plane perpendicular to axis 102.

Figure 2:
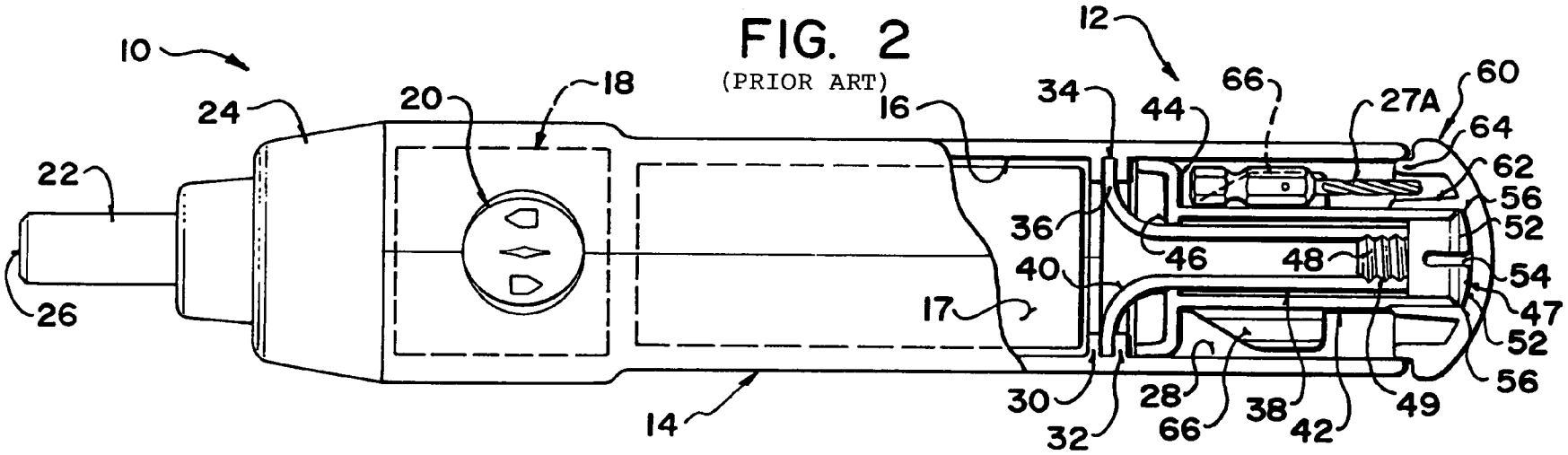
FIG. 2 (PRIOR ART)
FIG. 2 is a partially fragmented, partially sectioned side elevation view of the FIG. 1 prior art apparatus, showing the bit holder in the closed position.
Figure 3:
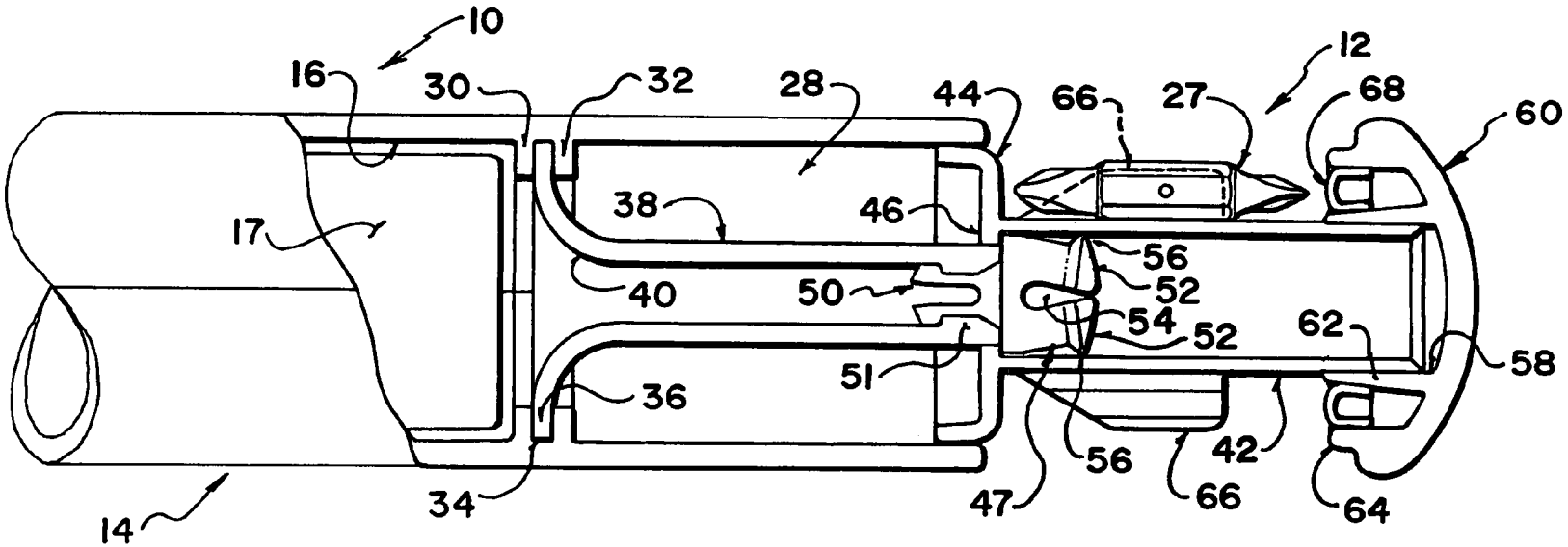
FIG. 3 (PRIOR ART)
FIG. 3 is an enlarged, partially fragmented, partially sectioned side elevation view of the bit holder end portion of the FIGS. 1 and 2 prior art apparatus, showing the bit holder in the open position.
Figure 12A:
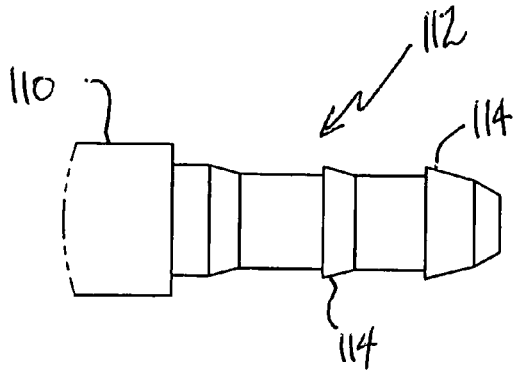
FIG. 12A is a side elevation view of a rearward end portion of a of bit cartridge support shaft having a stud engageable with the retainer depicted in FIGS. 4A-4C, 5A-5C, 6-9 and 11A-11C.
Figure 12B:
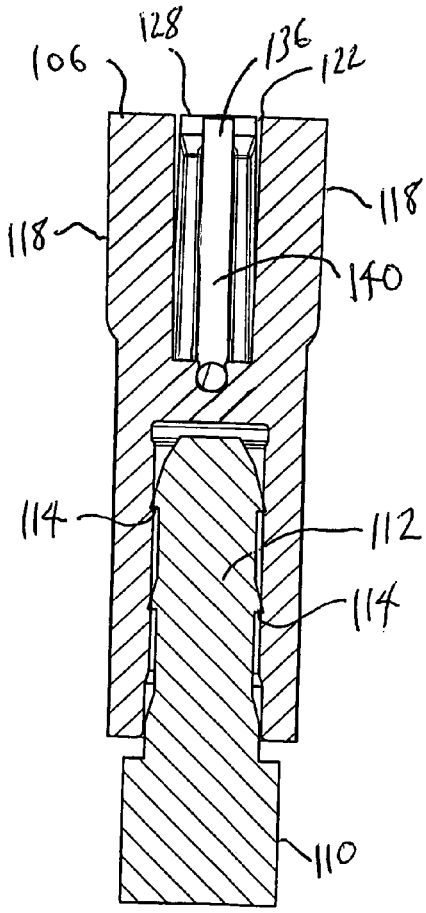
FIG. 12B is similar to FIG. 8 and also shows the FIG. 12A support shaft stud engaging the retainer.

A first cylindrical aperture 108 (FIGS. 4B, 5C, 7, 8, 11B and 12B) is formed through retainer 100's forward end 104, in axial alignment with axis 102. Retainer 100 is fixed on the rearward end of bit cartridge support shaft 110. This can be accomplished as shown in FIGS. 12A and 12B by providing a rearwardly extending stud 112 having one or more outwardly projecting, rearwardly and inwardly tapered, circumferential collars 114 on the rearward end of shaft 110. Stud 112 is formed of a flexible material such as plastic. The external diameter of each collar 114 is slightly greater than the internal diameter of aperture 108. Retainer 100's aperture 108 is slidably advanced over and along stud 112, inwardly compressing collars 114 within aperture 108 and securing retainer 100 on shaft 110. Persons skilled in the art will appreciate that other techniques can be used to fix retainer 100 on shaft 110, including provision of a spring-biased type clip (not shown, but similar to clip 50 shown in FIG. 3) on the forward end of retainer 100 for snap-fit engagement within a mating portion formed in or on the rearward end of shaft 110; or by appropriately threading the forward end of retainer 100 and the rearward end of shaft 110 for threaded engagement of retainer 100 and shaft 110 (not shown, but similar to threading 48 shown in FIG. 2).

Figure 1:
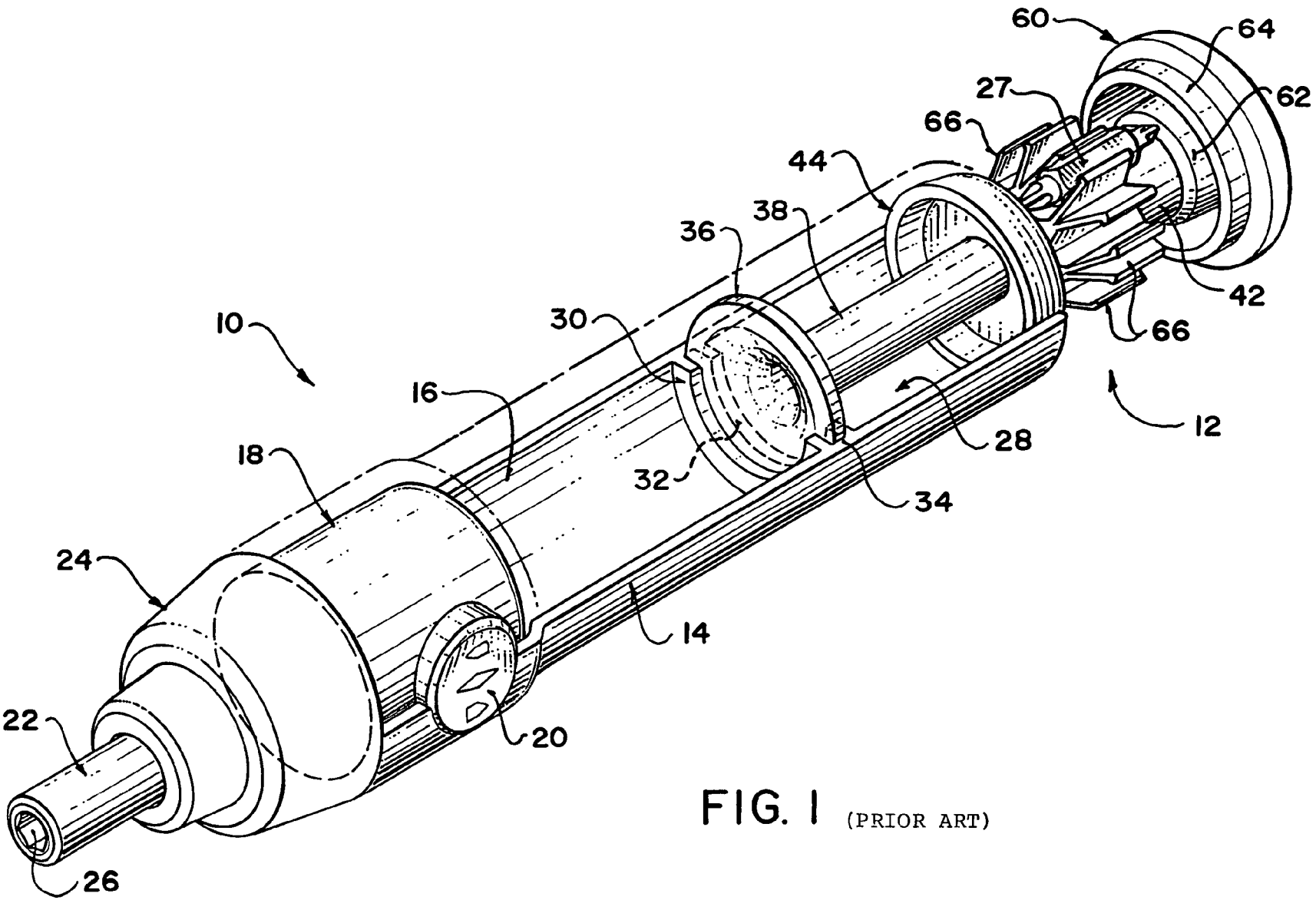
FIG. 1 (PRIOR ART)
FIG. 1 is a partially fragmented, partially schematic oblique pictorial illustration of a prior art battery-powered screwdriver having a bit holder which is shown in the open position.

Semi-cylindrical, circumferentially-spaced segments 118 are formed around retainer 100's rearward end 106. Segments 118 are sized and shaped to facilitate smooth sliding passage of retainer 100 within and along sleeve 42 (FIGS. 1-3) while inhibiting wobbling of retainer 100 with respect to sleeve 42. This can also be achieved by increasing the diameter of retainer 100 along a substantial portion of, or along the entirety of its length extending between forward and rearward ends 104, 106.

A pair of flexible, circumferentially spaced, transversely opposed first and second ribs 120, 122 are provided at retainer 100's rearward end 106 by forming circumferentially-spaced slots 124 through rearward end 106, generally parallel to axis 102. Outwardly projecting first and second lugs 126, 128 are formed on the rearward ends of ribs 120, 122 respectively. Since retainer 100 is formed of flexible material, ribs 120, 122 together with lugs 126, 128 can flex inwardly or outwardly with respect to axis 102. A second generally cylindrical aperture 129 is formed through retainer 100's rearward end 104, in axial alignment with axis 102, between segments 118 and ribs 120, 122.

Figure 9:
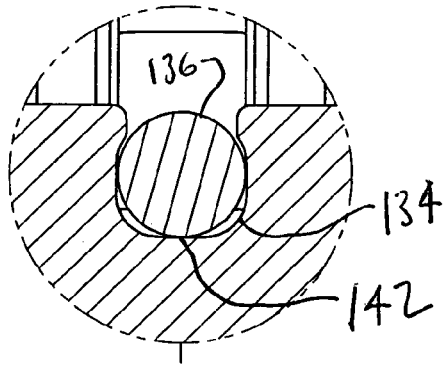
FIG. 9 is an enlarged view of the portion of the apparatus enclosed within the dashed circle shown in FIG. 8
Figure 7:
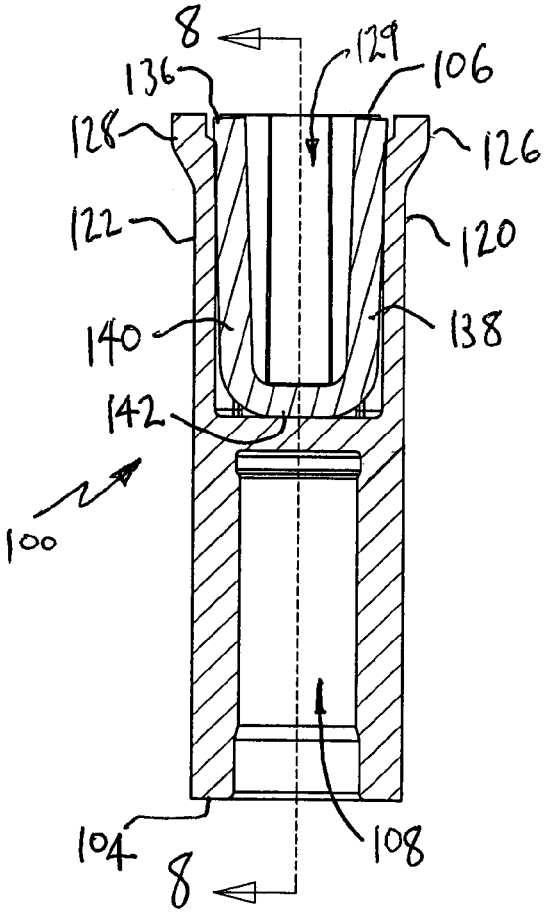
FIG. 7 is a sectional view taken with respect to line 7-7 shown in FIG. 6.
Figure 8:
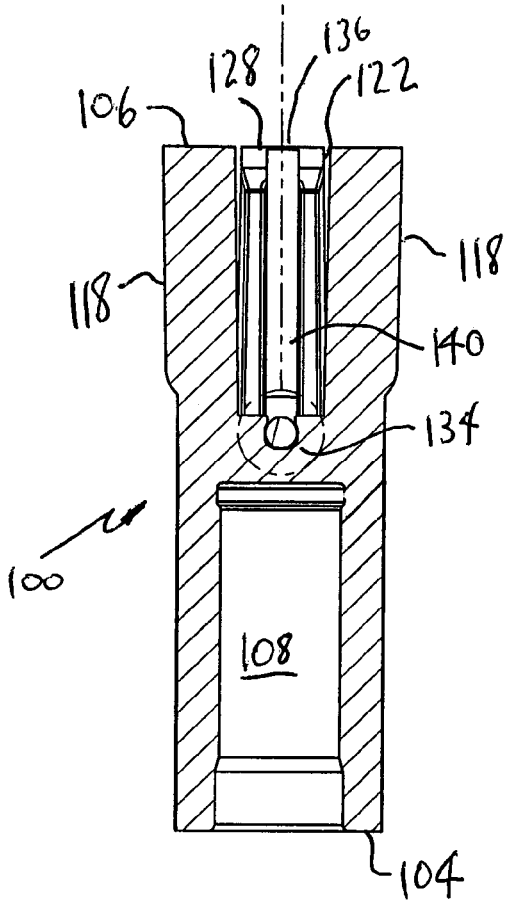
FIG. 8 is a sectional view taken with respect to line 8-8 shown in FIG. 7.

Semi-cylindrical channels 130, 132 are formed in and extend along the inward surfaces of ribs 120, 122 respectively, generally parallel to axis 102. A groove 134 is formed in the forward end base of aperture 129, between channels 130, 132. Channels 130, 132 and groove 134 are sized and shaped to receive spring 136 as explained below. As best seen in FIG. 9, the sidewalls of groove 134 are undercut to facilitate retention of spring 136 as explained below.

Figure 10C:
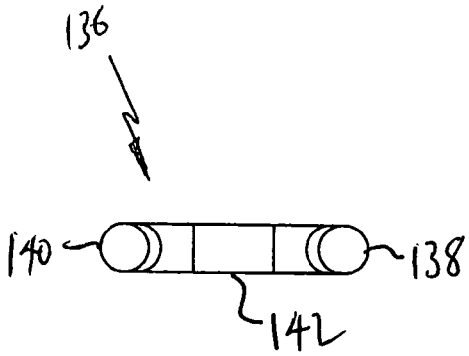
FIGS. 10A, 10B, 10C and 10D are respectively front elevation, side elevation, top plan and oblique pictorial views of the spring insert portion of the retainer depicted in FIGS. 4A-4C, 5A-5C and 6-9.
Figure 10D:
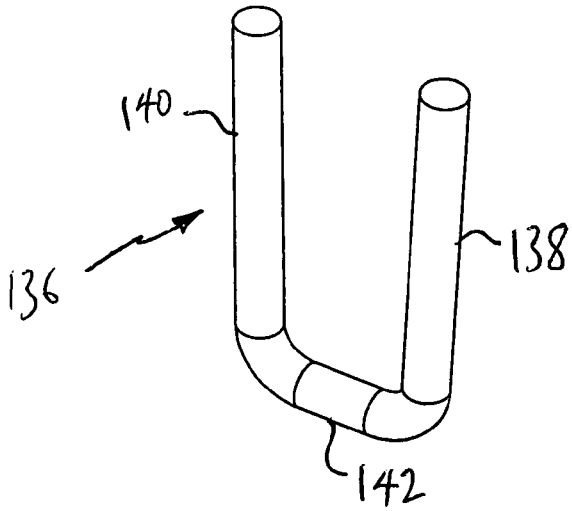
Figure 10A:
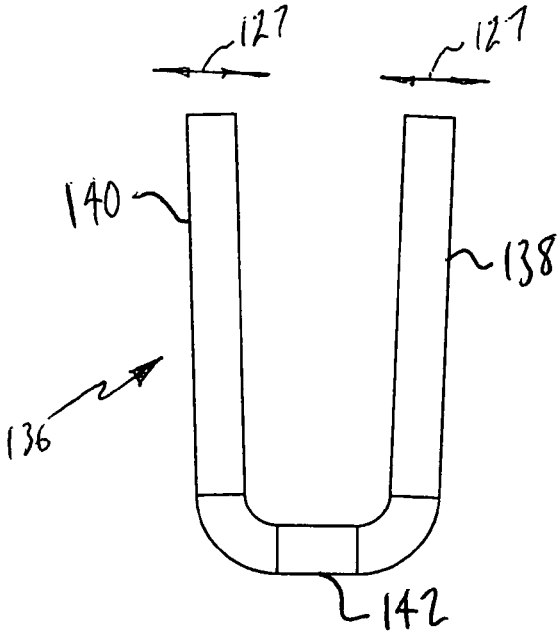
Figure 10B:
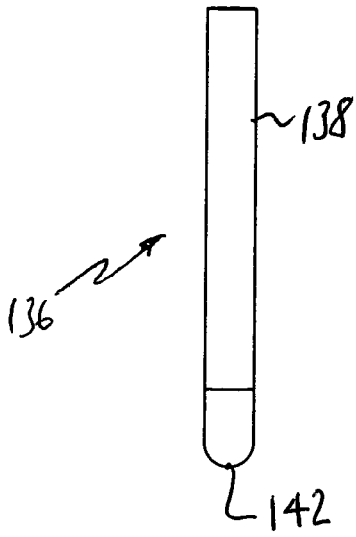
Figure 11A:
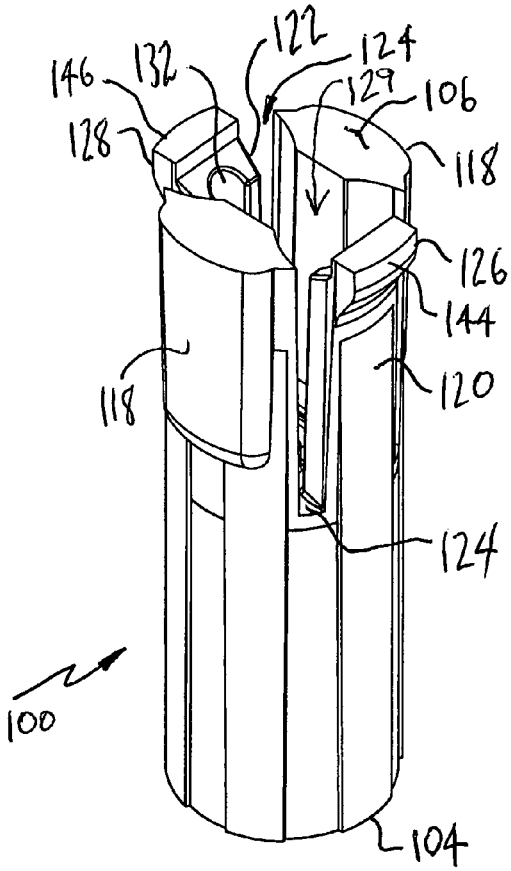
FIGS. 11A, 11B and 11C are similar to FIGS. 4A-4C respectively, but do not include the spring insert portion of the retainer.
Figure 11B:
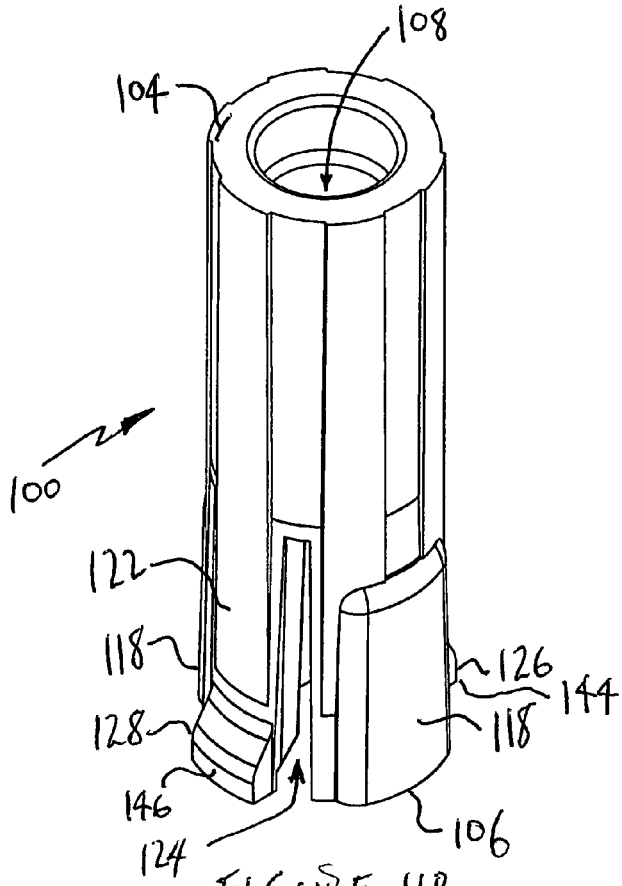
Figure 11C:
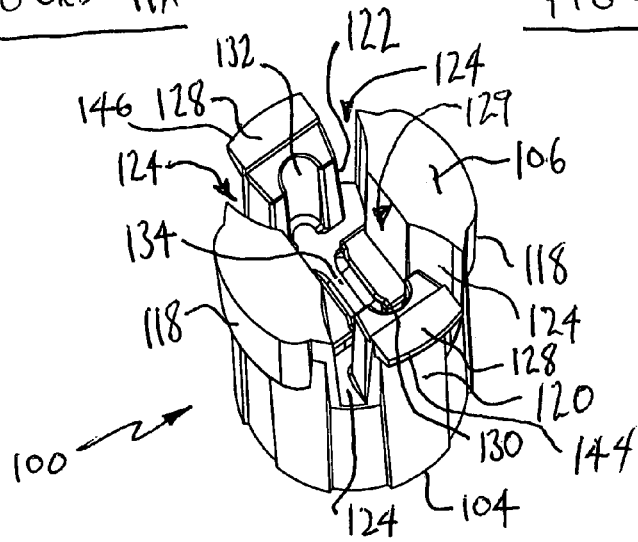

U-shaped spring 136 is slidably fitted into retainer 100's rearward apertured end 129, care being taken to fit spring 136's legs 138, 140 into channels 130, 132 respectively and to press-fit spring 136's base 142 into groove 134. Such press-fitting causes snap-fit engagement of base 142 within groove 134, thereby retaining spring 136 within channels 130, 132 and groove 134. Spring 136 is formed of spring steel or other material capable of sustaining repeated flexing without substantial loss of spring restoring force. Spring 136 is formed such that legs 138, 140 are normally outwardly biased, as best seen in FIG. 10A. The displacement between legs 138, 140 is selected, with respect to the displacement between opposed channels 130, 132 such that ribs 120, 122 and lugs 126, 128 are respectively biased outwardly away from axis 102 by spring 136. Spring 136 normally outwardly biases first rib 120 and first lug 126 in a first direction and normally outwardly biases second rib 122 and second lug 128 in a second direction transversely opposed to the first direction, as indicated by double-headed arrows 127 in FIGS. 4A and 10A.

When the screwdriver's bit holder is in the closed position, spring 136's outwardly biased legs 138, 140 force ribs 120, 122 outwardly. This in turn forces the outwardly protruding circumferentially ridged portions 144, 146 of lugs 126, 128 respectively into releasable, snap-fit engagement within the above-described radially outwardly enlarged circumferential recess 58 provided within the central, forward face of end cap 60 to firmly but releasably retain bit holder 12 in the closed position.

To move bit holder 12 into the open position, the user grasps the screwdriver's end cap 60 and draws it longitudinally away from the screwdriver. The force so exerted compresses lugs 126, 128 inwardly, compressing ribs 120, 122 against spring 136, overcoming the spring's outward bias, such that lugs 126, 128 circumscribe a reduced circumference permitting slidable movement of lugs 126, 128 through sleeve 42 as sleeve 42 is slidably drawn along shaft 38 into the previously described fully open position.

While a number of exemplary aspects and embodiments have been discussed above, those of skill in the art will recognize certain modifications, permutations, additions and sub-combinations thereof. For example, although it is preferred to form retainer 100 with a pair of transversely opposed ribs 120, 122 as described above, one may alternatively form retainer 100 with a single rib having a lug releasably engageable within recess 58. In such case, the portion of retainer 100's which is transversely opposed to the single rib is sized and shaped for slidable movement of the body in and along sleeve 42.

As another example, the body of retainer 100 need not be cylindrical about axis 102, although it is typically convenient to fabricate retainer 100 with a generally cylindrical body. It is sufficient to form a portion of the body of retainer 100 in a size and shape which is suitable for non-wobbling, slidable movement of retainer 100 in and along an internal region of sleeve 42. The size and shape of that portion of the body of retainer 100 is thus dependent upon the size and shape of the internal region of sleeve 42.

It is therefore intended that the following appended claims and claims hereafter introduced are interpreted to include all such modifications, permutations, additions and sub-combinations as are within their true spirit and scope.

What is claimed is:

1. A retainer for constraining slidable movement of a sleeve along a shaft between an open position and a closed position, the sleeve having an end cap fixed on a rearward end of the sleeve to provide a circumferential recess between the rearward end of the sleeve and a forward face of the end cap, the retainer comprising:

a body slidable in and along the sleeve;

first and second inwardly and outwardly flexible, transversely opposed, circumferentially spaced ribs at a rearward end of the body, the first rib having an outwardly projecting first lug releasably engageable within the recess at a rearward end of the first rib, the second rib having an outwardly projecting second lug releasably engageable within the recess at a rearward end of the second rib, a spring normally outwardly biasing the first rib and the first lug in a first direction, and normally outwardly biasing the second rib and the second lug in a second direction opposed to the first direction;

a first channel formed in and extending along an inward surface of the first rib to receive a first leg of the spring; and a second channel formed in and extending along an inward surface of the second rib to receive a second leg of the spring.

2. A retainer as defined in claim 1, wherein the spring is formed of a material capable of sustaining repeated flexing without substantial loss of spring restoring force.

3. A retainer as defined in claim 1, wherein the spring is formed of spring steel.

4. A retainer as defined in claim 1, wherein the first leg of the spring is normally outwardly biased in the first direction and the second leg of the spring is normally outwardly biased in the second direction.

5. A retainer as defined in claim 1, wherein at least a portion of the body is sized and shaped with respect to an internal region of the sleeve for non-wobbling, slidable movement of the body in and along the sleeve.

6. A retainer as defined in claim 1, further comprising two or more semi-cylindrcal, circumferentially-spaced segments formed on the rearward end of the body, the segments having an external diameter sized with respect to an internal diameter of the sleeve to permit non-wobbling slidable movement of the body in and along the sleeve.

7. A retainer as defined in claim 1, wherein the spring has a U shape comprising a base extending between the first leg and the second leg, the retainer further comprising a groove formed in the body to receive the base of the spring.

8. A retainer as defined in claim 7, wherein the groove is sized and shaped for snap-fit engagement and retention of the base of the spring within the groove.

9. A retainer as defined in claim 7, wherein the first and second lugs are outwardly biased into the recess when the sleeve is in the closed position, retaining the sleeve in the closed position.

10. A retainer as defined in claim 7, wherein when the sleeve is in the closed position, application of a force to move the end cap rearwardly away from the shaft compresses the first and second lugs inwardly, compressing the first and second ribs against the spring and overcoming the spring's outward bias, such that the lugs circumscribe a reduced circumference permitting slidable movement of the lugs through the sleeve.

11. A retainer as defined in claim 7, the rearward end of the shaft having a rearwardly extending stud, the retainer further comprising a longitudinally extending aperture formed through a forward end of the body for non-releasable engagement of the stud within the aperture.

12. A retainer as defined in claim 7, the rearward end of the shaft having a rearwardly extending stud with an outwardly projecting collar, the retainer further comprising a longitudinally extending aperture formed through a forward end of the body, the collar having an external diameter slightly greater than an internal diameter of the aperture, for non-releasable engagement of the stud within the aperture.

13. A retainer as defined in claim 7, the rearward end of the shaft having a rearwardly extending stud with an outwardly projecting, rearwardly and inwardly tapered collar, the retainer further comprising a longitudinally extending aperture formed through a forward end of the body, the collar having an external diameter slightly greater than an internal diameter of the aperture, for non-releasable engagement of the stud within the aperture.

14. A retainer as defined in claim 7, the retainer further comprising a spring-biased clip on a forward end of the body, the rearward end of the shaft having a recess sized and shaped for snap-fit engagement and retention of the clip.

15. A retainer as defined in claim 7, the retainer further comprising a spring-biased clip on the rearward end of the shaft, the forward end of the body having a recess sized and shaped for snap-fit engagement and retention of the clip.

16. A retainer as defined in claim 7, wherein:

the rearward end of the shaft is threaded; and a forward end of the body is threaded for mating threadable engagement of the shaft with the body.

* * * * *